US005893496A

United States Patent [19]

Katz et al.

[11] Patent Number: 5,893,496

[45] Date of Patent: Apr. 13, 1999

[54] UTILITY HEADBAND AND HOLSTER SYSTEM

[76] Inventors: Rodney Katz; Nancy Katz, both of 4009 Livingstone Avenue North, Victoria, BC V8N 5Z4, Canada; David Lockyer, 505 Langvista Drive, Victoria, BC V9B 5J6, Canada

[21] Appl. No.: 08/510,040

[22] Filed: Aug. 1, 1995

[51] Int. Cl.[6] ..... F21L 15/14

[52] U.S. Cl. ..... 224/181; 224/901.4; 224/675; 224/250

[58] Field of Search ..... 224/181, 240, 224/250, 675, 901.4, 930; 362/105, 190, 191, 108, 388; 2/918; D3/229

[56] References Cited

U.S. PATENT DOCUMENTS

| | | | |
|---|---|---|---|
| 4,174,793 | 11/1979 | Wisowaty | 224/240 |
| 4,399,934 | 8/1983 | Dupont | 224/240 |
| 4,797,793 | 1/1989 | Fields . | |
| 4,804,121 | 2/1989 | Stanton et al. | 224/901.4 |
| 4,970,631 | 11/1990 | Marshall . | |
| 5,053,932 | 10/1991 | Case . | |
| 5,217,294 | 6/1993 | Liston . | |
| 5,412,545 | 5/1995 | Rising | 224/250 |
| 5,458,267 | 10/1995 | Curtis et al. | 224/930 |
| 5,460,308 | 10/1995 | Hahn | 224/901.4 |
| 5,535,928 | 7/1996 | Herring | 224/901 |

*Primary Examiner*—Charles R. Eloshway
*Attorney, Agent, or Firm*—Christensen O'Connor Johnson & Kindness PLLC

[57] ABSTRACT

A headband for retaining and positioning an object is adapted to have an active configuration and an alternative passive configuration. In the active configuration, the headband can be made to encircle a user's head such that the object is retained on an exterior surface ready for use. In the passive configuration, the headband can be made to close around the object such that the object is retained on an interior surface, protected against damage, with the headband retained in a compact form. In this passive configuration, the headband can releasably engage a belt so as to form a holster for the object, thereby rendering both the object and the headband ready for rapid deployment.

2 Claims, 4 Drawing Sheets

UTILITY HEADBAND AND HOLSTER SYSTEM

FIELD OF THE INVENTION

This invention relates to devices that retain and position tools. More specifically, this invention relates to a headband that retains and positions a flashlight for hands-free operation but which can be arranged to form a protective case or holster for the flashlight.

BACKGROUND OF THE INVENTION

Headbands for retaining and positioning flashlights are known. Typical of such devices is the one shown in U.S. Pat. No. 5,053,932, granted on Oct. 1, 1991, to Richard N. Case for a "Flashlight Retainer". The '932 patent describes an elongated band having two ends adapted to releasably engage each other so as to form a circular headband having an outside face and an inside face. The inside face fits snugly against the head of the user while the outside face includes an elastic loop for retaining and positioning a flashlight.

Other similar devices are known. Typically, these devices differ by their means for retaining the flashlight or by their means for adjusting the headband to fit different head sizes. Examples of such other devices are shown in U.S. Pat. No. 4,797,793, granted on Jan. 10, 1989, to Tom R. Fields for a "Headband for Holding a Flashlight", U.S. Pat. No. 5,217,294, granted on Jun. 8, 1993, to James W. Liston for a "Head Mounted Multi-Position Flashlight Holder", and U.S. Pat. No. 4,970,631, granted on Nov. 13, 1990, to Timothy E. Marshall for a "Headband Device for Holding Flashlight".

Unfortunately, known flashlight-retaining headbands have a number of disadvantages.

Although these devices are suitable for retaining a flashlight on a person's head, this arrangement is not the normal state for either the flashlight or the person. People generally do not walk about with flashlights on their heads and flashlights are generally found in places other than on people's heads.

The known headbands do not assist a person to carry a flashlight anywhere except on the head. Designed for active flashlight use, these devices expose the flashlight to damage during passive carriage.

When not worn, the headband is loose and susceptible to snagging on objects. To avoid snagging the headband, the user must either wrap it cumbersomely around the flashlight or remove it entirely and store it separately from the flashlight. In either case, over time the user will be prone to forget the headband, to lose it, or to intentionally leave it behind. Without the headband, the user must either carry the flashlight in hand or find an alternative device for retaining or carrying the flashlight.

Similarly, the known devices are not suitable for storing a flashlight between uses. They leave the flashlight exposed and susceptible to damage, and their elongated, flexible structure is prone to becoming a tangled mess.

What is needed is a flashlight-retaining headband that is also suitable for carrying the flashlight during passive use and for storing the flashlight between uses. The present invention is directed to such a device.

SUMMARY OF THE INVENTION

According to one aspect of the invention there is provided an apparatus for retaining and positioning an object, comprising: a substantially flexible member having a first end, a second end opposite the first end, opposite longitudinal edges, a first surface bounded by the first end, the second end and the edges, and a second surface opposite the first surface, means, connected to the first surface, for retaining and positioning the object, first alternate means for reversibly closing the flexible member to form a single loop with the portion of the first surface proximate the object-retaining means defining a section of exterior surface exposing the object-retaining means, and second alternate means for reversibly closing the flexible member such that the portion of the first surface proximate the object-retaining means defines a section of interior surface covering the object-retaining means.

The member can be either unitary or constructed of discrete sections. Each of the discrete sections might be substantially rigid, substantially elastic or substantially inelastic.

The retaining means can be either a pocket, a loop, or a fastener, and can include means for increasing the frictional forces between the object and the retaining means. The retaining means can be attached to the member proximate to the midpoint between the first end and the second end or proximate to the first end.

The first alternate closing means can include cooperating patches of hook and loop material, a fastener, or a cooperating pair of male and female connectors. The second alternate closing means can further include means for releasably retaining a mounting device, such as a belt.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figures 1, 2:
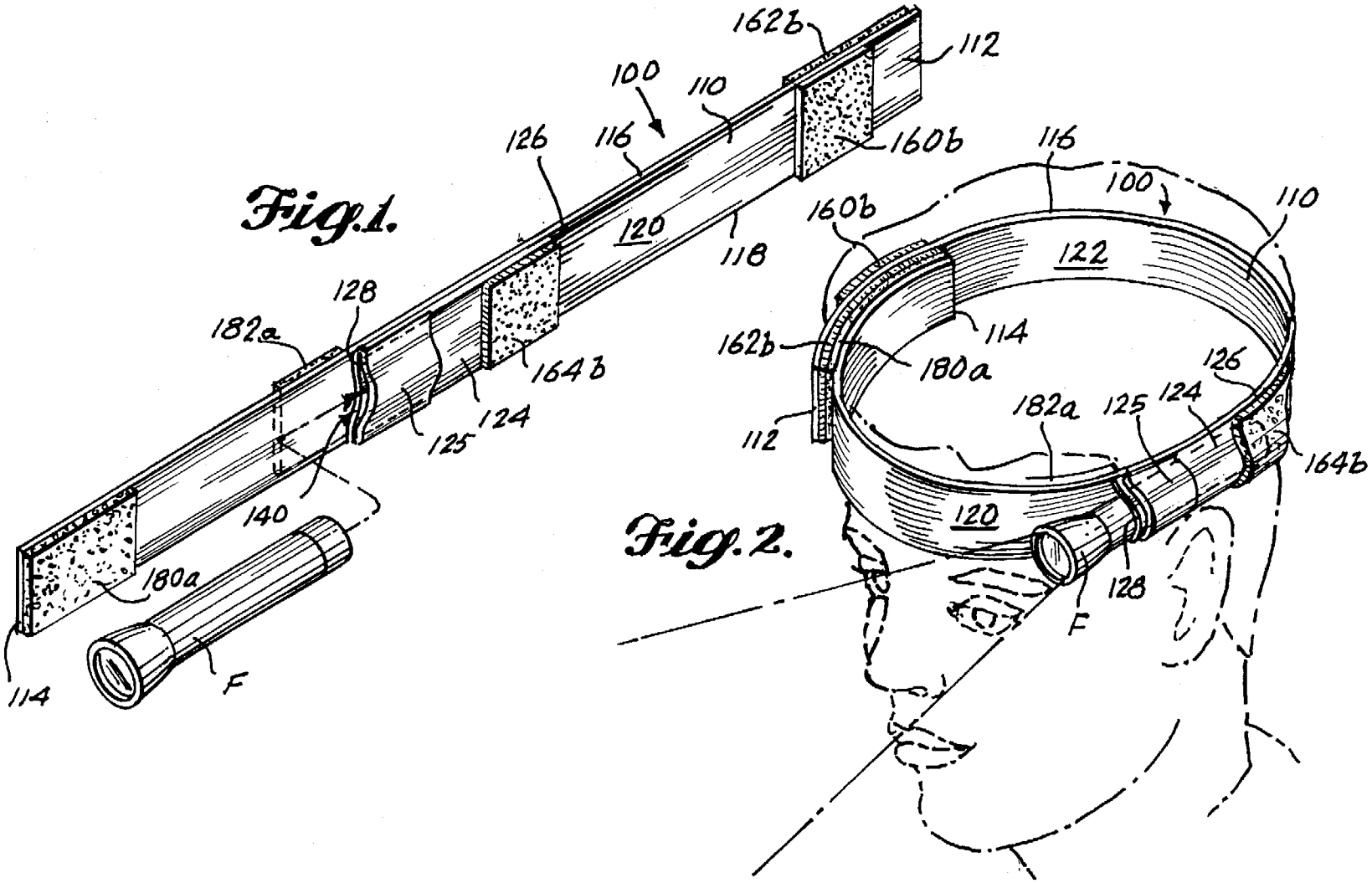
FIG. 1 is a top perspective of a headband embodying one aspect of the invention, in its open configuration.
FIG. 2 is a top perspective of the headband of FIG. 1, in its headband or loop configuration.

With reference to FIGS. 1 and 2, the headband 100 embodying one aspect of the invention is formed from an elongated band 110 having a first end 112, a second end 114 opposite the first end, first and second longitudinal edges 116 and 118, respectively, a first face 120 bounded by the first and second ends 112, 114 and the first and second edges 116, 118 and a second face 122 opposite the first face 120. The first and second ends 112, 114 may include first and second terminators such as metal clips or heavy-duty stitching to improve resistance to wear and prevent unraveling.

The band may be constructed of either an elastic or an inelastic material that is durable and comfortable to wear. A preferred elastic material is two inch wide polyester braided elastic. A preferred nonelastic material is cordura, a polyester-based canvas-like material. The materials are generically known as belting or narrow fabrics.

A short strip of material 124, approximately the same width as the band 110, is affixed to a portion of the band between its first end 112 and its second end 114. The strip 124 has a first end 126, and a second end 128 opposite the first end 126. The longitudinal margins of the strip 124 are affixed to the band 110 by stitching, metal or plastic hardware fasteners, or chemical or fusion bonds such that a pocket 140 is formed between the first surface 120 of the band 110 and the strip 124. The pocket opens along the second end 128 of the pocket-forming strip. The first end 126 of the strip can also be open, but preferably is closed by having its margin affixed to the first surface 120 of the band. The pocket 140 is sized for retaining and positioning a device such as a miniature flashlight F.

Complemental connectors are located along the band 110. For example, the connectors can be patches of complemental hook and loop materials, or mating male and female pins and sockets, or any other complemental fastenings or connectors which securely, but detachably, connect to each other, preferably by engagement. Other examples of such complementary connector pairs are: positive and negative poles of magnets, male and female snaps, buttons and buttonholes, tongue and groove fasteners, bolts and nuts, balls and sockets, hooks and clasps, mated compression fittings, and generally male and female connectors. Other examples of pairs of connectors which are similar but which are considered "complemental" for the purposes of this application are: laces, ties and zippers. Where an endpoint 112, 114 of the band 110 is being connected, it is also contemplated that a loop, D-ring, cleat, clamp, clasp, barb or other such tie-point would be an appropriate connector. Where the two endpoints 112, 114 of the band 110 are being connected together, it is contemplated that they could be knotted or otherwise tied together. In the preferred embodiment, hook and loop fastening patches are used. Connectors of one type are referred to as "positive," have reference numbers with an "a" suffix and are stippled, while connectors of the other, complemental type are referred to as "negative," have reference numbers with a "b" suffix and are marked with horizontal cross hatches.

At the first end 112 of the band 110 are a first negative connector **160*b* located on the first surface 120, and a second negative connector 162*b* located on the second surface 122. A third negative connector 164*b* is located on the outside surface of the pocket-forming strip 124 toward its first end 126**.

At the second end 114 of the band 110 is a first positive connector **180*a* located on the first surface 120. A second positive connector 182*a* is located on the second surface 122 of the band 110 between its first and second ends 112, 114 and close to the second end 128 of the pocket-forming strip 124**.

With reference to FIG. 2, the band 110 will now be described as operated in headband configuration. Without twisting the band 110 about its longitudinal centerline, the user wraps the band 110 into a single loop such that the first end 112 and the second end 114 are overlapping and proximate, with the second end 114 located to the inside of the first end 112. The second negative connector **162*b* and the first positive connector 180*a* are then brought together and releasably engaged to close the loop. The loop forms a substantially cylindrical shell having an exterior surface formed by the first surface 120 and an interior surface formed by the second surface 122. The pocket formed by strip 124 opens at the exterior surface and thereby is disposed to retain and position flashlight F for unobstructed use. In this headband configuration, the band 110 can be wrapped around and secured to the head of the user, or various other objects such as a tree trunk, or a vehicle sun-visor. An additional strip 125, preferably elastic, can be secured at the outside of the pocket strip 124 to define an additional support for a flashlight (such as one having a different shank size or shape) or a small tool, pen or pencil, etc. Alternatively, stitching can be set along the longitudinal centerline of the strip 125** to define two additional supports for small flashlights or tools.

Figure 4:
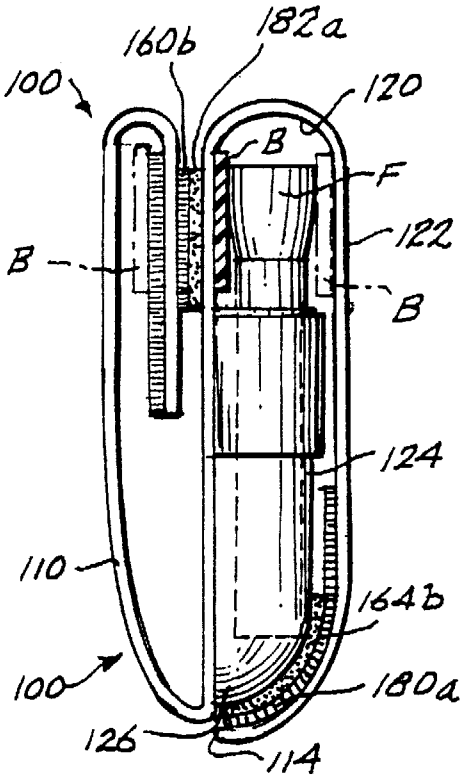
FIG. 4 is a side elevation of the headband of FIG. 1, in the storage-holster configuration of FIG. 3.
Figure 3:
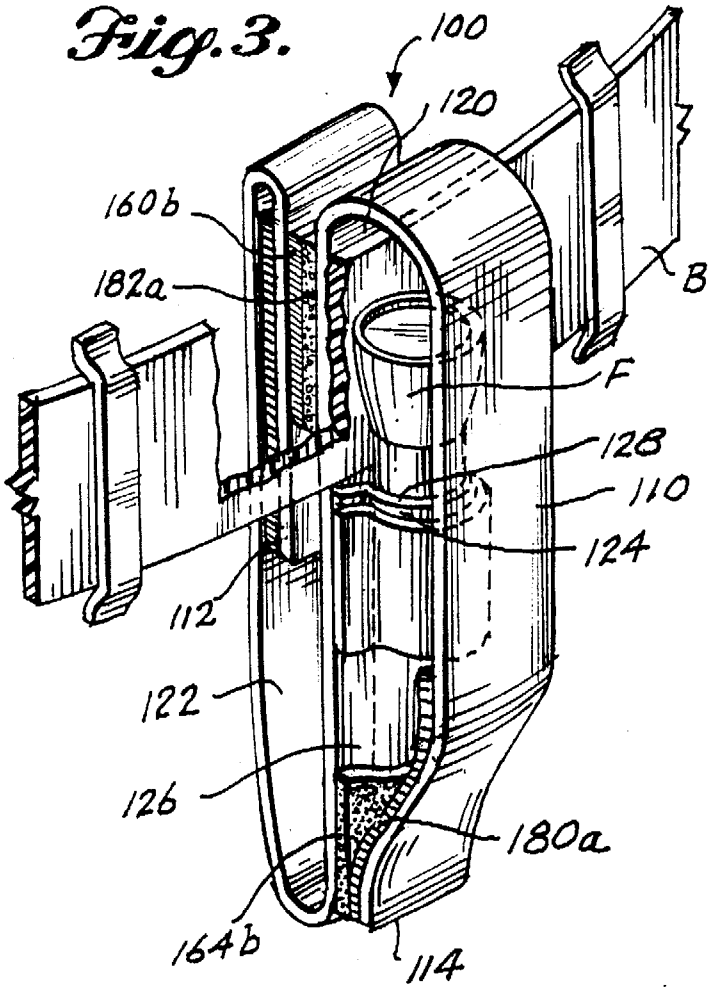
FIG. 3 is a top perspective of the headband of FIG. 1, in a storage configuration which also can act as a holster configuration.

With reference now to FIGS. 3 and 4, the band 110 will now be described as used in a storage configuration. The user folds the second end 114 of the band 110 over the strip 124 until the second end 114 overlaps the strip's first end 126. Preferably the resulting flap overlying the flashlight is pulled tight to engage the portion of the flashlight projecting from the pocket, to assist in retaining the flashlight in the pocket (the position of the upper portion of the flap is exaggerated in the drawings). The third negative **164*b* and the first positive connector 180*a* are then brought together and releasably engaged such that the portion of the first surface 120 of the band 110 between its second end 114 and the first end 126 of the strip 124** now defines an interior surface that overlies and protects the flashlight F held within the pocket.

The user then folds the first end 112 of the band 110 to a position proximate to the second end 128 of the strip 124, at the second surface 122 of the band. The first negative connector **160*b* and the second positive connector 182*a* are then brought together and releasably engaged such that the portion of the band 110 between its first end 112 and the second end 128 of the strip 124 form a closed loop. The assembly now forms a compact protective casing for the flashlight F, with no loose ends. However, the casing can be conveniently opened for access to the flashlight by disengaging the first positive connector 180*a* from the third negative connector 164*b***.

Still referring to FIGS. 3 and 4, the band 110 will now be described as used in a holster configuration. The holster configuration is substantially the same as the storage configuration except that the user threads the band 110 around a belt B to mount the holster. In the configuration shown in FIG. 3 and in solid lines in FIG. 4, belt B passes between the head of flashlight F projecting from its pocket and the first surface 120 of the band, immediately above the pocket-forming strip 124. Alternative locations for the belt to pass through the band 110 are shown in broken lines in FIG. 4. The solid line location is preferred because in this position the belt cooperates with the band 110 to retain the flashlight F in position. It should be understood that the user might choose to thread the belt through the band 110 instead of vice versa.

Figure 5:
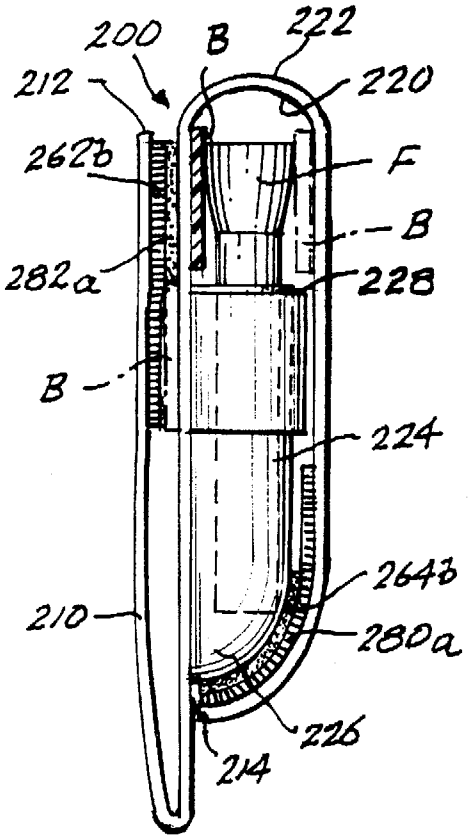
FIG. 5 is a side elevation of a first alternative embodiment of a headband in accordance with the present invention, in a storage-holster configuration.

With reference now to FIG. 5, a first alternative embodiment of a headband in accordance with the present invention is illustrated generally at 200. The headband 200 is formed from an elongated band 210 having a first end 212, a second end 214 opposite the first end 212, opposite longitudinal edges, a first face 220 bounded by the first and second ends 212, 214 and the opposite longitudinal edges, and a second face 222 opposite the first face 220. The first and second ends 212, 214 may include first and second terminators.

A short pocket-forming strip of material 224 is affixed to a portion of the band 210 between its first end 212 and its second end 214 in the same manner as the previously described embodiment. The strip 224 has a first end 226, a second end 228 opposing the first end 226, and longitudinal margins joined to the first face 220 of the band to form a pocket for the flashlight F. The pocket opens along the second end 228 of the strip 224. The other end portion of the pocket, adjacent to the first end 226 can also be open but preferably is closed by being joined to the band.

At the first end 212 of the band 210 is a first negative connector **262*b* located on the second surface 222. A second negative connector 264*b* is attached to the outer side of the pocket-forming strip 224 toward its first end 226. At the second end 214 of the band 210 is a first positive connector 280*a* located on the first surface 220. A second positive connector 282*a* is attached to the second surface 222 of the band 210 between its first and second ends 212, 214 and toward the second end 228 of the strip 224**.

The method of placing the first alternative band 210 into headband configuration will now be described. Without twisting the band 210 about its longitudinal axis, the user wraps the band 210 into a single loop such that the first end 212 and the second end 214 overlap, with the second end 214 on the inside. The first negative connector **262*b* and the first positive connector 280*a* are then brought together and releasably engaged such that the second surface 222 of the band 210 defines the interior surface of a substantially cylindrical shell and the first surface 220 of the band 210 defines the exterior surface of the substantially cylindrical shell. The pocket, being located on the first surface 220 of the band 210**, is exposed at the exterior surface of the substantially cylindrical shell and thereby disposed to retain and position the flashlight F for unobstructed use.

With reference again to FIG. 5, the band 210 will now be described as used in a storage configuration. The user folds the second end 214 of the band 210 over the pocket-forming strip 224. The second negative connector **264*a* and the first positive connector 280*b* are then brought together and releasably engaged such that the portion of the first surface 220 of the band 210 between the second end 214 of the band 210 and the first end 226 of the strip 224** now defines an interior surface containing and protecting the flashlight F held within the pocket.

The user can then bring the first end 212 of the band 210 proximate to the second end 228 of the pocket-forming strip 224, but on the reverse side of the band. The first negative connector 262b and the second positive connector **282*a* are then brought together and releasably engaged such that the portion of the second surface 222 of the band 210 between the first end 212 of the band 210 and the second end 228 of the strip 224** continues to define an interior surface.

With reference still to FIG. 5, the band 210 will now be described as used in a holster configuration. The holster configuration is substantially the same as the storage configuration except that the user threads the band 210 around a belt B to mount the holster 200. Alternative locations for the belt to pass through the band 210 are indicated in broken lines. It should be understood that the user might choose to thread the belt through the band 210 instead of vice versa.

Figure 6:
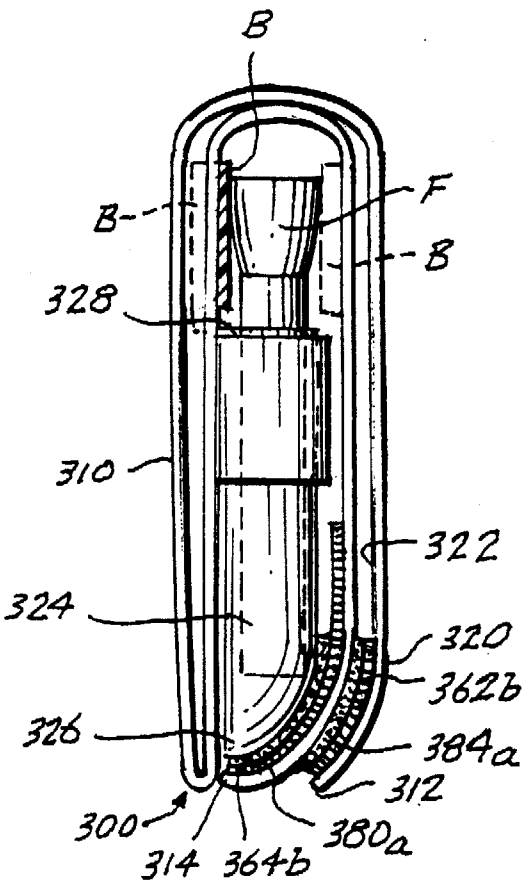
FIG. 6 is a side elevation of a second alternative embodiment of a headband in accordance with the present invention, in a storage-holster configuration.

With reference now to FIG. 6, a second alternative embodiment of a headband is illustrated generally at 300. The headband 300 is formed from an elongated band 310 having a first end 312, a second end 314 opposite the first end 312, opposite longitudinal edges, a first face 320 bounded by the first and second ends 312, 314 and the longitudinal edges and a second face 322 opposite the first face 320. The first and second ends 312, 314 may include first and second terminators.

A pocket-forming strip of material 324 is affixed to a portion of the band 310 between its first end 312 and its second end 314. The strip 324 has a first end 326, a second end 328, and opposite longitudinal margins joined to the band as for the previously-described embodiments.

At the first end 312 of the band 310 is a first negative connector **362*b* located on the second surface 322. A second negative connector 364*b* is attached to the outside of the pocket-forming strip 324 toward the first end 326. At the second end 314 of the band 310 is a first positive connector 380*a* located on the first band surface 320 and a second positive connector 384*a* located on the second surface 322**.

The method of placing the second alternative band 310 into headband configuration will now be described. Without twisting the band 310 about its longitudinal axis, the user wraps the band 310 into a loop such that the first end 312 and the second end 314 are proximate. The first negative connector **362*b* and the first positive connector 380*a* are then brought together and releasably engaged such that the second surface 322 of the band 310 defines the interior surface of a substantially cylindrical shell and the first surface 320 of the band 310 defines the exterior surface of the substantially cylindrical shell. The pocket 340, being adjacent to the first surface 320 of the band 310** opens at the exterior surface of the substantially cylindrical shell and thereby is disposed to retain and position the flashlight F for unobstructed use.

With reference again to FIG. 6, the band 310 will now be described as used in a storage configuration. The user brings the second end 314 of the band 310 proximate to the first end 326 of the pocket-forming strip 324. The second negative connector **364*b* and the first positive connector 380*a* are then brought together and releasably engaged such that the portion of the first surface 320 of the band 310 between the second end 314 of the band 310 and the first end 326 of the pocket-forming strip 324** now defines an interior surface containing and protecting the flashlight F held within the pocket.

The user then brings the first end 312 of the band 310 over the top of the second end 328 of the pocket-forming strip 324 and then proximate to the first end 326 of the strip 324. The first negative connector **362*b* and the second positive connector 384*a* are then brought together and releasably engaged such that the portion of the second surface 322 of the band 310 between the first end 312 of the band 310 and the first end 326 of the strip 324** continues to define an interior surface.

With reference still to FIG. 6, the band 310 will now be described as used in a holster configuration. The holster configuration is substantially the same as the storage configuration except that the user threads the band 310 around a belt B to mount the holster 300. Alternative locations for the belt to pass through the band 310 are indicated in broken lines. It should be understood that the user might choose to thread the belt through the band 310 instead of vice versa.

Figure 7:
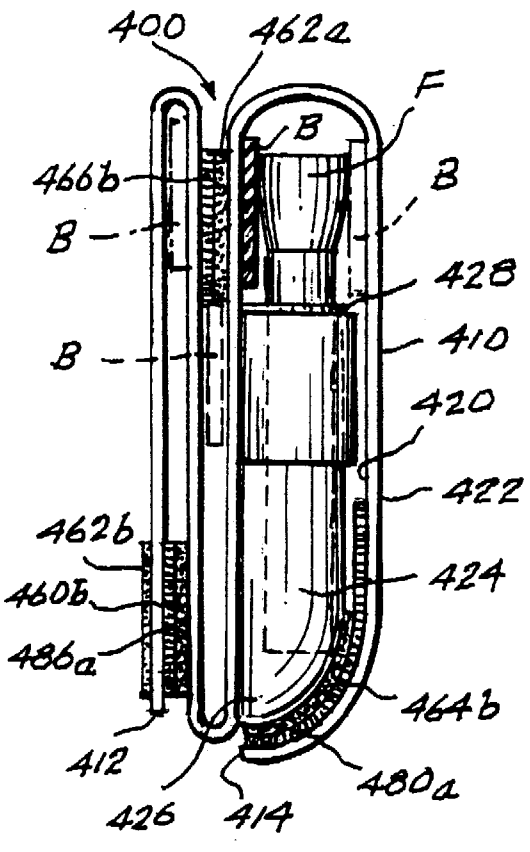
FIG. 7 is a side elevation of a third alternative embodiment of a headband in accordance with the present invention, in a storage-holster configuration.

With reference now to FIG. 7, a third alternative embodiment of a headband is illustrated generally at 400. The headband 400, is formed from an elongated band 410 having a first end 412, a second end 414 opposing the first end 412, opposite longitudinal edges, a first face 420 bounded by the first and second ends 412, 414 and the opposite edges and a second face 422 opposite the first face 420. The first and second ends 412, 414 may include first and second terminators.

A pocket-forming strip of material 424 is affixed to a portion of the band 410 between its first end 412 and its second end 414 as for the previously-described embodiments. The pocket-forming strip 424 has a first end 426 and a second end 428. The resulting pocket is suitable for retaining and positioning a device such as a miniature flashlight F.

At the first end 412 of the band 410 is a first negative **460*b* located on the first surface 420 and a second negative connector 462*b* located on the second surface 422. A third negative connector 464*b* is attached to the outside of the pocket-forming strip 424 toward the first end 426. A fourth negative connector 466*b* is attached to the second surface 422 of the band 410 approximately midway between the first end 412 of the band 410 and the first end 426 of the strip 424**.

At the second end 414 of the band 410 is a first positive connector **480*a* located on the first surface 420. A second positive connector 482*a* is attached to the second surface 422 of the band 410 at the second end 428 of the pocket-forming strip 424. A third positive connector 486*a* is connected to the first surface 420 of the band 410 proximate to the first end 426 of the strip 424**.

The method of placing the third alternative band 410 into headband configuration (not shown), will now be described. Without twisting the band 410 about its longitudinal axis, the user wraps the band 410 into a loop such that the first end 412 and the second end 414 overlap. The second negative connector **462*b* and the first positive connector 480*a* are then brought together and releasably engaged such that the second surface 422 of the band 410 defines the interior surface of a substantially cylindrical shell and the first surface 420 of the band 410 defines the exterior surface of the substantially cylindrical shell. The pocket formed by strip 424** opens at the exterior surface of the substantially cylindrical shell and thereby is disposed to retain and position the flashlight F for unobstructed use.

With reference again to FIG. 7, the band 410 will now be described as used in a storage configuration. The user brings the second end 414 of the band 410 proximate to the first end 426 of the pocket-forming strip 424. The third negative connector **464*b* and the first positive connector 480*a* are then brought together and releasably engaged such that the portion of the first surface 420 of the band 410 between the second end 414 of the band 410 and the first end 426 of the pocket-forming strip 424** now defines an interior surface containing and protecting the flashlight F held within the pocket.

The user then folds the portion of the band 410 between the first end 412 of the band and the first end 426 of the strip 424 into an N-shaped pattern wherein the first surface 420 of the band 410 defines the interior of the first arch of the "N" while the second surface 422 of the band 410 defines the interior of the second arch of the "N". The fourth negative connector **466*b* and the second positive connector 482*a* are brought together and releasably engaged. The first negative connector 460*b* and the third positive connector 486*a*** are then brought together and releasably engaged.

With reference still to FIG. 7, the band 410 will now be described as used in a holster configuration. The holster configuration is substantially the same as the storage configuration except that the user threads the band 410 around a belt B to mount the holster 400. Alternative locations for the belt to pass through the band 410 are indicated in broken lines. It should be understood that the user might choose to thread the belt through the band 410 instead of vice versa.

Figure 8:
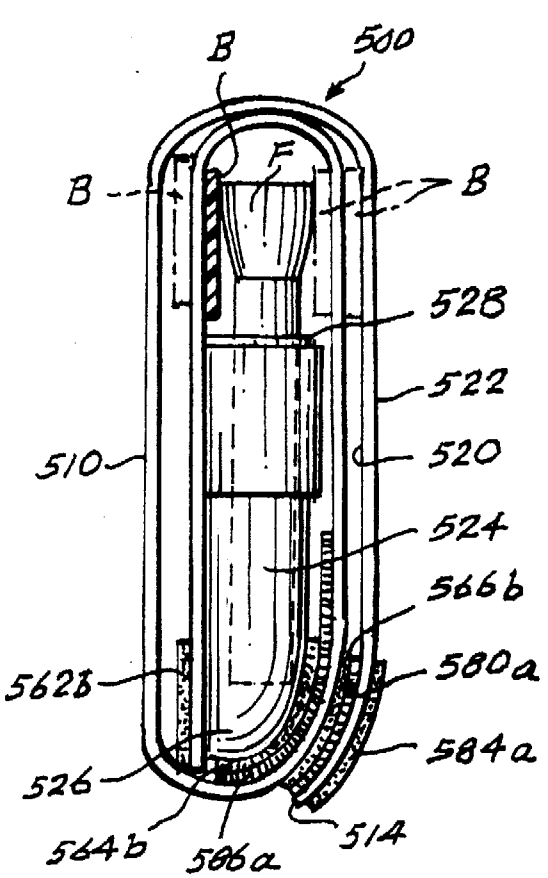
FIG. 8 is a side elevation of a fourth alternative embodiment of a headband in accordance with the present invention, in a storage-holster configuration.

With reference now to FIG. 8, a fourth alternative embodiment of a headband is illustrated generally at 500. The headband 500 is formed from an elongated band 510 having a first end 512, a second end 514 opposite the first end 512, opposite longitudinal edges, a first face 520 bounded by the first and second ends 512, 514 and the longitudinal edges, and a second face 522 opposite the first face 520. The first and second ends 512, 514 may include first and second terminators.

A pocket-forming strip of material 524 is affixed to a portion of the band 510 at its first end 512 as described for the previous embodiments. The strip 524 has a first end 526 (preferably closed), and a second end 528 (open). The resulting pocket opens along the second end 528 of the strip 524. The pocket 540 is suitable for retaining and positioning a device such as a miniature flashlight F.

At the first end 512 of the band 510 is a first negative connector **562*b* located on the second surface 522 of the band 510. A second negative connector 564*b* is attached to the outside of the strip 524 toward its first end 526. A third negative connector 566*b* is located on the second surface 522 of the band 510, approximately midway between the first and second ends 512 and 514**.

At the second end 514 of the band 510 is a first positive connector **580*a* located on the first surface 520 and a second positive connector 584*a* located on the second surface 522. A third positive connector 586*a* is affixed to the first surface 520 of the band 510, approximately midway between the first and second ends 512 and 514 and proximate to the third negative connector 566*b***.

The method of placing the fourth alternative band 510 into headband configuration will now be described. Without twisting the band 510 about its longitudinal axis, the user wraps the band 510 into a loop such that the first end 512 and the second end 514 overlap. The first negative connector **562*b* and the first positive connector 580*a* are then brought together and releasably engaged such that the second surface 522 of the band 510 defines the interior surface of a substantially cylindrical shell and the first surface 520 of the band 510** defines the exterior surface of the substantially cylindrical shell. The pocket opens at the exterior surface of the substantially cylindrical shell and is thereby disposed to retain and position the flashlight F for unobstructed use.

With reference again to FIG. 8, the band 510 will now be described as used in a storage configuration. The user brings the second end 514 of the band 510 over and around the second end 528 of the pocket-forming strip 524, around the first end 526 of the strip 524, and once again over and around the second end 528 of the strip 524 until the second end 514 of the band 510 is proximate the first end 526 of the strip 524. The second negative connector **564*b* and the third positive connector 586*a* are brought together and releasably engaged. The first positive connector 580*a* and the third negative connector 586*b* are then brought together and releasably engaged such that the first surface 520** of the band 510 is now at all points an interior surface, the portion between the second end 528 of the pocket-forming strip 524 and the third positive connector 586*a* containing and protecting the flashlight F held within the pocket.

With reference still to FIG. 8, the band 510 will now be described as used in a holster configuration. The holster configuration is substantially the same as the storage configuration except that the user threads the band 510 around a belt B to mount the holster 500. Alternative locations for the belt to pass through the band 510 are indicated in broken lines. It should be understood that the user might choose to thread the belt through the band 510 instead of vice versa.

Figure 9:
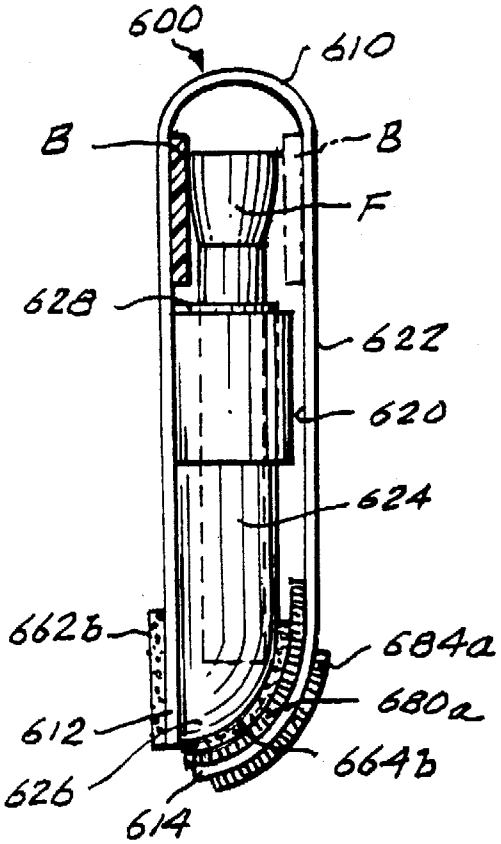
FIG. 9 is a side elevation of a fifth alternative embodiment of a headband in accordance with the present invention, in a storage-holster configuration.

With reference now to FIG. 9, a fifth alternative embodiment of a headband is illustrated generally at 600. The headband 600, is formed from an elongated band 610 having a first end 612, a second end 614, opposite longitudinal edges, a first face 620 bounded by the first and second ends 612, 614 and a second face 622 opposite the first face 620. The first and second ends 612, 614 may include first and second terminators.

A pocket-forming strip of material 624 is affixed to a portion of the band 610 at its first end 612. The strip 624 has a first end 626 (preferably closed), and a second end 628 (open). The strip 624 is affixed to the band as described for the prior embodiments. The resulting pocket is suitable for retaining and positioning a device such as a miniature flashlight F.

At the first end 612 of the band 610 is a first negative connector 662*b* located on the second surface 622 of the band 610. A second negative connector 664*b* is attached to the outside of the pocket-forming strip 624 toward its first end 626.

At the second end 614 of the band 610 is a first positive connector 680*a* located on the first surface 620 and a second positive connector 684*a* located on the second surface 622.

The method of placing the fifth alternative band 610 into headband configuration will now be described. Without twisting the band 610 about its longitudinal axis, the user wraps the band 610 into a loop such that the first end 612 and the second end 614 overlap. The first negative connector 662*b* and the second positive connector 684*a* are then brought together and releasably engaged such that the second surface 622 of the band 610 defines the interior surface of a substantially cylindrical shell and the first surface 620 of the band 610 defines the exterior surface of the substantially cylindrical shell. The pocket, being adjacent the first surface 620 of the band 610, opens at the exterior surface thereby is disposed to retain and position the flashlight F for unobstructed use.

With reference again to FIG. 9, the band 610 will now be described as used in a storage configuration. The user brings the second end 614 of the 610 over and around the second 628 of the pocket-forming strip 624. The second negative connector 664*b* and the first positive connector 680*a* are brought together and releasably engaged such that the first surface 620 of the band 610 is now at all points an interior surface, containing and protecting the flashlight F held within the pocket.

With reference still to FIG. 9, the 610 will now be described as used in a holster configuration. The holster configuration is substantially the same as the storage configuration except that the user threads the band 610 around a belt B to mount the holster 600. An alternative location for the belt to pass through the band 610 is indicated in broken lines. It should be understood that the user might choose to thread the belt through the band 610 instead of vice versa.

Figure 10:
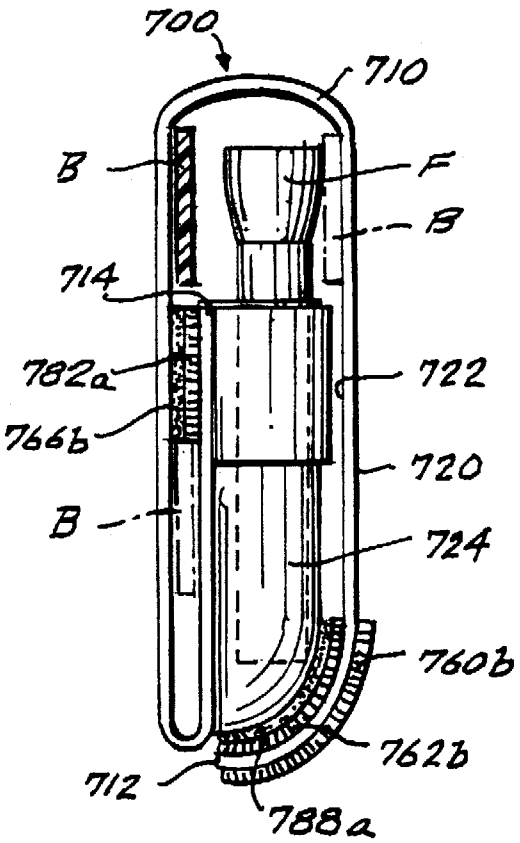
FIG. 10 is a side elevation of a sixth alternative embodiment of a headband in accordance with the present invention, in a storage-holster configuration.

With reference now to FIG. 10, a sixth alternative embodiment of a headband is illustrated generally at 700. The headband 700, is formed from an elongated band 710 having a first end 712, a second end 714 opposite the first end 712, opposite longitudinal edges, a first face 720 bounded by the first and second ends 712, 714 and the edges and a second face 722 opposite the first face 720. The first and second ends 712, 714 may include first and second terminators.

A pocket-forming strip of material 724 is affixed to a portion of the band 710 at its second end 714 in the manner described above. The strip 724 has a first end 726 (preferably closed) and a second end 728 (open). The strip 724 is affixed to the band 710 as for the previously described embodiments. The pocket opens along the second end 728 of the strip 724, suitable for retaining and positioning a device such as a miniature flashlight F.

At the first end 712 of the band 710 is a first negative connector 760*b* located on the first surface 720 of the band 710 and a second negative connector 762*b* on the second surface 722 of the band 710. A third negative connector 766*b* is attached to the second surface 722 of the end 710 approximately one third of the length of the band 710 from the first end 712.

At the second end 714 of the band 710 is a first positive connector 782*a* located on the second surface 722. A second positive connector 788*a* is affixed to the first surface 734 of the strip 724 at its first end 726.

The method of placing the sixth alternative band 710 into headband configuration will now be described. Without twisting the band 710 about its longitudinal axis, the user wraps the band 710 into a loop such that the first end 712 and the second end 714 overlap. The first negative connector 760*b* and the first positive connector 782*a* are then brought together and releasably engaged such that the second surface 722 of the band 710 defines the interior surface of a substantially cylindrical shell and the first surface 720 of the band 710 defines the exterior surface of the substantially cylindrical shell. The pocket formed by strip 724 opens at the exterior surface of the substantially cylindrical shell and thereby is disposed to retain and position the flashlight F for unobstructed use.

With reference again to FIG. 10, the band 710 will now be described as used in a storage configuration. The user brings the first end 712 of the band 710 over and around the second end 728 of the pocket-forming strip 724 and down toward the first end 726 of the strip 724. The second negative connector 762*b* and the second positive connector 788*a* are then brought together and releasably engaged such that the first surface 720 of the band 710 between the second end 714 of the band 710 and the first end 726 of the strip 724 becomes an interior surface, containing and protecting the flashlight F held within the pocket against the second surface 722 of the band 710.

With reference still to FIG. 10, the band 710 will now be described as used in a holster configuration. The holster configuration is substantially the same as the storage configuration except that the user threads the band 710 around a belt B to mount the holster 700. Alternative locations for the belt to pass through the band 710 are indicated in broken lines. It should be understood that the user might choose to thread the belt through the band 710 instead of vice versa.

Figure 11:
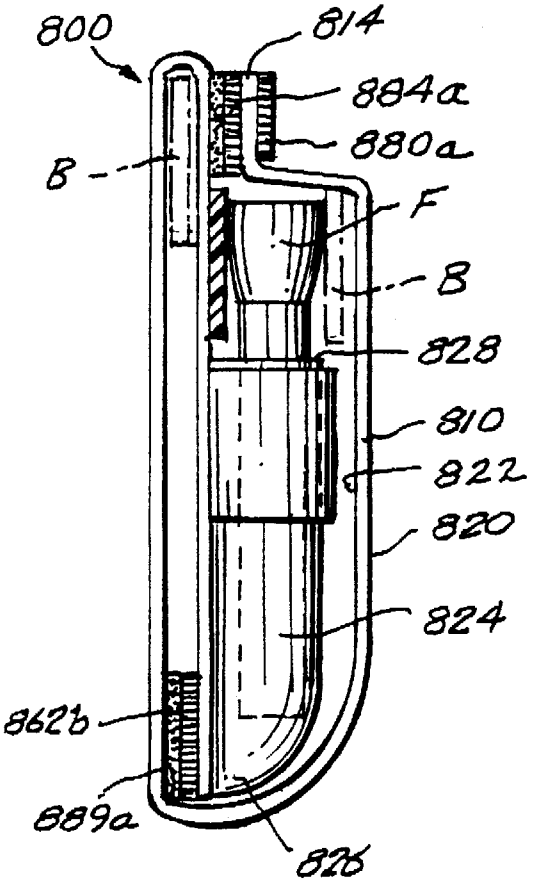
FIG. 11 is a side elevation of a seventh alternative embodiment of a headband in accordance with the present invention, in a storage-holster configuration.

With reference now to FIG. 11, a seventh alternative embodiment of a headband is illustrated generally at 800. The headband 800 is formed from an elongated band 810 having a first end 812, a second end 814 opposing the first end 812, opposite longitudinal edges, a first face 820 bounded by the first and second ends 812, 814 and the edges and a second face 822 opposite the first face 820. The first and second ends 812, 814 may include first and second terminators.

A pocket-forming strip of material 824 is affixed to a portion of the band 810 at its first end 812. The strip 824 has a first end 826 (preferably closed) and, a second end 828 (open). The strip 824 is affixed to the band 810 as for the previously described embodiments. The resulting pocket opens along the second end 828 of the strip 824, suitable for retaining and positioning a device such as a miniature flashlight F.

At the first end 812 of the band 810 is a first negative connector **862*b* located on the second surface 822 of the band 810. A second negative connector 868*b* is attached to the first surface 820 of the band 810 approximately one third of the length of the band 810 from the first end 812**.

At the second end 814 of the band 810 is a first positive connector **880*a* located on the first surface 820 and a second positive connector 884*a* located on the second surface 822. A third positive connector 889*a* is affixed to the second surface 822 of the band 810 approximately one third of the length of the band 810 from the second end 814**.

The method of placing the seventh alternative band 810 into headband configuration, will now be described. Without twisting the band 810 about its longitudinal axis, the user wraps the band 810 into a loop such that the first end 812 and the second end 814 overlap. The first negative connector **862*b* and the first positive connector 880*a* are then brought together and releasably engaged such that the second surface 822 of the band 810 defines the interior surface of a substantially cylindrical shell and the first surface 820 of the band 810 defines the exterior surface of the substantially cylindrical shell. The pocket 840** opens at the exterior surface of the substantially cylindrical shell and is thereby disposed to retain and position the flashlight F for unobstructed use.

With reference again to FIG. 1 1, the band 810 will now be described as used in a storage configuration. The user brings the second end 814 of the band 810 under and around the first end 826 of the pocket-forming strip 824 and up toward the second end 828 of the strip 824. The third positive connector **889*a* and the first negative connector 862*b* are brought together and releasably engaged. The second negative connector 868*b* and the second positive connector 884*a* are then brought together and releasably engaged such that the first surface 820 of the band 810 between the first end 812 of the band 810 and the second negative connector 868*b* becomes an interior surface, containing and protecting the flashlight F held within the pocket against the second surface 822 of the band 810**.

With reference still to FIG. 11, the band 810 will now be described as used in a holster configuration. The holster configuration is substantially the same as the storage configuration except that the user threads the band 810 around a belt B to mount the holster 800. Alternative locations for the belt to pass through the band 810 are shown in broken lines. It should be understood that the user might choose to thread the belt through the band 810 instead of vice versa.

Although a number of specific embodiments of the present invention have been described and illustrated, the present invention is not limited to the features of these embodiments, but includes all variations and modifications within the scope of the claims. Those skilled in the art will see many variations that fall within the spirit of the invention.

For example, all described embodiments exhibit a common general property. Each embodiment includes a band adapted to alternately occupy one of two states. In the first state, the band presents a single loop having an interior surface and an exterior surface. In the second state, at least a portion of the first state exterior surface is transformed into an interior surface. This general property allows a flashlight to be alternately exposed for use and protected for storage.

Although the bands described have been unitary which is preferred, this property is not absolutely necessary. The bands could be formed piecemeal from a series of elastic and inelastic panels. The bands could even be constructed of a plurality of substantially rigid panels that are flexibly connected together. Although the bands described have been planar and sheet-like, these geometries are again not necessary.

It should also be understood that the exact placement and arrangement of connectors is not crucial, so long as the arrangement selected allows the band to alternately occupy both the first state and the second state as described hereinabove. In particular, in the embodiments described, connectors were placed at the very ends of the bands so that loose ends did not exist.

Although the pocket is preferably constructed by lapping a strip of material over the band, other constructions are possible. Other containment means might include a free-standing pocket, a loop or a series of loops, ties, or metal or plastic hardware fasteners. Multiple pockets are contemplated. It is further contemplated that the interior surface of the pocket could include means for increasing the frictional forces between the pocket and the flashlight. Such friction increasing means might include lining or coating the pocket with rubber, grit, or other frictional materials.

It is also contemplated that the headband could hold objects other than a flashlight. Such other devices might include a bicycle mirror, a magnifying glass, or a transceiver.

The embodiments of the invention in which an exclusive property or privilege is claimed are defined as follows:

1. An apparatus for retaining and positioning an object, comprising:

a) an elongated unitary band having a first end, a second end, opposite longitudinal edges, a first surface bounded by the first end, the second end, and the longitudinal edges, and a second surface opposite the first surface;

b) a receptacle on the first surface of the band for retaining and positioning the object, the receptacle being attached to the band proximate to the midpoint between the first end and the second end, and the receptacle including a pocket;

c) a first pair of complemental connectors disposed, respectively, at the first end and the second end of the band for maintaining the band in a first configuration forming a single substantially closed ring with the first surface disposed at the exterior of the ring and the second surface disposed at the interior of the ring with the receptacle exposed at the exterior of the ring;

d) a second pair of complemental connectors for maintaining the band in a separate configuration with a portion of the band wrapped over and covering the receptacle, wherein at least one of the second pair of complemental connectors is not either of the first pair of complemental connectors and is thereby distinct; and e) a third pair of complemental connectors respectively disposed proximate to the receptacle on the second surface of the band and disposed proximate to the second end of the band on the first surface, for augmenting the second configuration by maintaining the second end of the band folded behind the pocket and secured to the second surface of the band thereat, thereby forming the portion of the band between the pocket and the second end into a closed loop for engaging a mounting device, the first surface being disposed at the exterior of the loop and the second surface being disposed at the interior of the loop.

2. An apparatus for retaining and positioning an object, comprising:

a) a substantially flexible, elongated, unitary band having a first end, a second end opposite the first end, opposite longitudinal edges, a first surface bounded by the first end, the second end, and the longitudinal edges, and a second surface apposite the first surface;

b) a pocket for retaining and positioning he object, the pocket being disposed on the first surface of the band substantially midway between the band's first and second ends;

c) first and second complemental connectors disposed, respectively, at the first end of the band on the first surface and at the second end of the band on the second surface for maintaining the band in a first configuration forming a single ring with the first surface disposed at the exterior of the ring and the second surface disposed at the interior of the ring with the pocket exposed at the exterior of the ring;

d) a third connector, distinct from the first and second connectors and complemental with the first connector, disposed proximate to the pocket on the first surface of the band, for maintaining the band in a separate second configuration with the portion of the band proximate to the first end folding over and covering the pocket; and e) fourth and fifth complemental connectors, distinct from the first, second, and third connectors and disposed respectively proximate to the pocket on the second surface of the band and proximate to the second end of the band on the first surface for augmenting the second configuration by maintaining the second end of the band folded behind the pocket and secured to the second surface of the band thereat, thereby forming the portion of the band between the pocket and the second end into a closed loop for engaging a mounting device, the first surface being disposed at the end of the loop and the second surface being disposed at the interior of the loop.

* * * * *